US006533517B1

(12) United States Patent
Kutschan et al.

(10) Patent No.: US 6,533,517 B1
(45) **Date of Patent: *Mar. 18, 2003**

(54) COMPOUND DIP PROCESS FOR METAL CANS

(75) Inventors: Reinhard Kutschan, Salzqitter (DE); Hellmut Bünsch, Hamburg (DE)

(73) Assignee: Schmalbach-Lubeca AG, Braunschweig (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/686,718

(22) Filed: Oct. 10, 2000

Related U.S. Application Data

(63) Continuation of application No. 08/849,948, filed on Aug. 20, 1997, now Pat. No. 6,129,494.

(30) Foreign Application Priority Data

Dec. 23, 1994 (DE) ..... 44 46 393

(51) Int. Cl.[7] ..... B21D 51/26

(52) U.S. Cl. ..... 413/1; 413/2; 413/4; 413/7; 413/27; 413/34

(58) Field of Search ..... 413/1, 2, 4–7, 413/26, 27, 34

(56) References Cited

U.S. PATENT DOCUMENTS

| | | | | |
|---|---|---|---|---|
| 3,986,629 A | | 10/1976 | Singleton | |
| 4,055,271 A | | 10/1977 | Kronenwetter et al. | 220/64 |
| 4,089,283 A | | 5/1978 | Mertens et al. | |
| 5,143,504 A | | 9/1992 | Braakman | 413/6 |
| 5,947,673 A | * | 9/1999 | Strube | |
| 6,129,494 A | * | 10/2000 | Kutschan et al. | |

FOREIGN PATENT DOCUMENTS

| | | |
|---|---|---|
| CH | 669 574 | 3/1989 |
| DE | 42 29 923 | 3/1994 |
| EP | 0 108 701 | 5/1984 |
| FR | 2 499 092 | 8/1982 |
| FR | 2 720 305 | 12/1995 |
| FR | 2 739 354 | 4/1997 |
| WO | WO 96/17031 | 6/1996 |

OTHER PUBLICATIONS

Copy of Search Report.

* cited by examiner

*Primary Examiner*—Eugene Kim
(74) *Attorney, Agent, or Firm*—Duane Morris LLP

(57) ABSTRACT

Sealant is applied onto or into a folded-seam closure of a metal can. Instead of introducing sealant into the U-shaped lid flange and drying, according to the invention the compound or sealant is applied to the base flange, the base of the metal can being dipped into a current of fluid sealant or at least brought into contact with it at the surface. This substantially improves the precision of dosing and the exact amount of applied sealant.

3 Claims, 2 Drawing Sheets

COMPOUND DIP PROCESS FOR METAL CANS

CROSS-REFERENCE TO RELATED APPLICATION

This application is a continuation of U.S. application Ser. No. 08/849,948, filed Aug. 20, 1997, issued on Oct. 10, 2000 as U.S. Pat. No. 6,129,494 which is a 371 of PCT/OE95/01855, filed Dec. 22, 1995.

BACKGROUND OF THE INVENTION

1. Field of the Invention

The technical field of the invention is a process for an application of sealant (so-called "compound") to a body hook of a body of a metal can.

2. Prior Art

Prior art realizes sealings on metal packings such that a sealant, which is usually provided on the basis of a rubber preparation or a synthetic caoutchouc, is dispersed in water or organic solvents (SBC or WBC) and introduced into the end hook of a can end or into the fold edge of a can base with a spraying gun. Subsequently, the water or the solvent (mixture) has to be evaporated and the dried seal has to be stored at least 24 hours before closing the can end and the can body (compare DE-A 27 27 628 or U.S. Pat. No. 4,201,308). In the prior art process, the quantity of sealant used is subject to a statistical variation, the effectively introduced or applied sealant depending to a considerable degree on the viscosity, which in turn depends on the temperature. Consequently, the temperature determines the quantity of sealant introduced, namely the circumferential distribution of sealant as well as the thickness of the sealant introduced.

SUMMARY OF THE INVENTION

It is an object of the present invention to improve the processes for introduction or application of sealant previously used, particularly with regard to their precision and reproducibility. The objective is to make the quantity of sealant applied or introduced independent on external influences to such a degree that it may be positioned more precisely to permit on a long-term basis the saving of considerable quantities of sealant.

Said object is achieved by applying a sealant to the body hook of a can body and not to a can end, said application being effected before flanging the seam, which particularly is a double seam.

By realizing the inventive idea, a frequent control of the sealant is not required, the can body itself being dipped from above into the sealant or contacting it to such a degree that only the portion of the body hook is wetted with said sealant. Compared to prior art, the inventive process permits a better positioning and therefore, a more precise application and consequently a more economizing dosing of the sealant. Thus a considerable quantity of sealant is saved over a fairly long time. Due to the invention, defects in the rubber-coating of can ends are a thing of the past.

To fluidize the raw sealant, it is softened (fluidized), usually by an extruder or compounder. The compound may then be transferred on a gravure roller which may be supplied by a sheet die, however, said sheet die itself also being able to provide the fluidal compound without using a deep-draw roller[1], said compound presenting a certain minimum dipping depth; said minimum depth may be controlled (claim 3).

[1] German term "Tiefziehwalze" (=deep-draw roller) must obviously read correctly "Tiefdruckwalze" (=gravure roller).

Also, time, speed and dipping depth of the dipping movement of the body hook may be controlled.

The application of compound on the seam portion of the can body (body hook) is improved with regard to uniformity by rotating said can body in the indicated direction α, (alpha) around its own axis at least when it contacts or is dipped into the sealant. For this purpose, a magnetic drive (for soft metal[2] cans) may be provided.

[2] German term "Weichblechdosen" (=soft metal cans) is an obvious typing error. The correct term is "Weigblechdosen" (=tin plate cans).

By combining a dipping movement in vertically downward direction and a rotatory movement around the axis, a high degree of uniformity of sealant on the body hook is achieved, simultaneously permitting a precise positioning and dosing and thus savings of largest possible quantities of sealant to achieve smallest necessary quantities of sealant on the body hook.

In the following, the invention is described more in detail on the basis of embodiments.

DETAILED DESCRIPTION OF THE PREFERRED EMBODIMENT

If a can is in closed condition, an end hook 2*a*,2*b* is seamed together with a body hook 1*a* to provide an air-tight double seam D. A sealant C is provided on the upper portion of the seam portion, between the seam portion 1*a* of the can body and the outer seam portion 2*b* of the can end portion 2*a*,2*b*, and, possibly, a further sealant F is provided on the lower portion of said seam.

Figure 2:
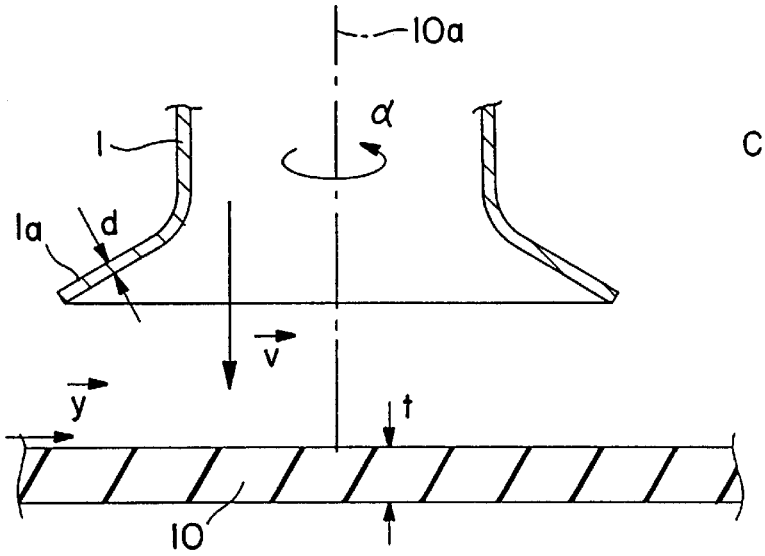
FIG. 2 shows the dipping movement in downward direction of a schematically illustrated can body 1 into a fluidal sealant 10 being continuously replenished in y direction ("stream of sealant").
Figure 3:
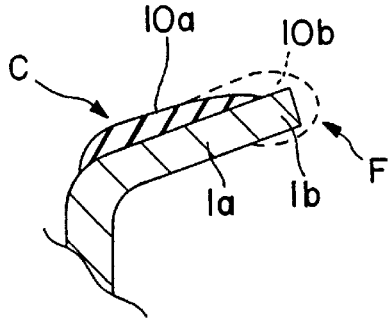
FIG. 3 is an enlarged view of the edge portion of a seam portion 1*a* of a can body, onto which a defined, precisely dosed quantity lOa of a sealant has been applied according to the process of FIG. 2.

FIGS. 2 and 3 illustrate the application of at least one of said sealants C and F.

FIG. 2 illustrates the principle, according to which a can body 1, being shown schematically, is dipped into a fluidal sealant 10 ("raw sealant"). Said can body 1 is moved downward v in direction of the can axis 100 until the body hook 1*a* contacts said fluidal compound 10. Said movement v may as well be continued a further downward, so that the lower (reverse) surface of said body hook 1*a* is also dipped.

The dipping depth may exceed the thickness d of the metal sheet so that said compound 10 also reaches the reverse side (upper side) of said body hook 1*a*, thus providing a sealing portion F when the can is closed.

Figure 4:
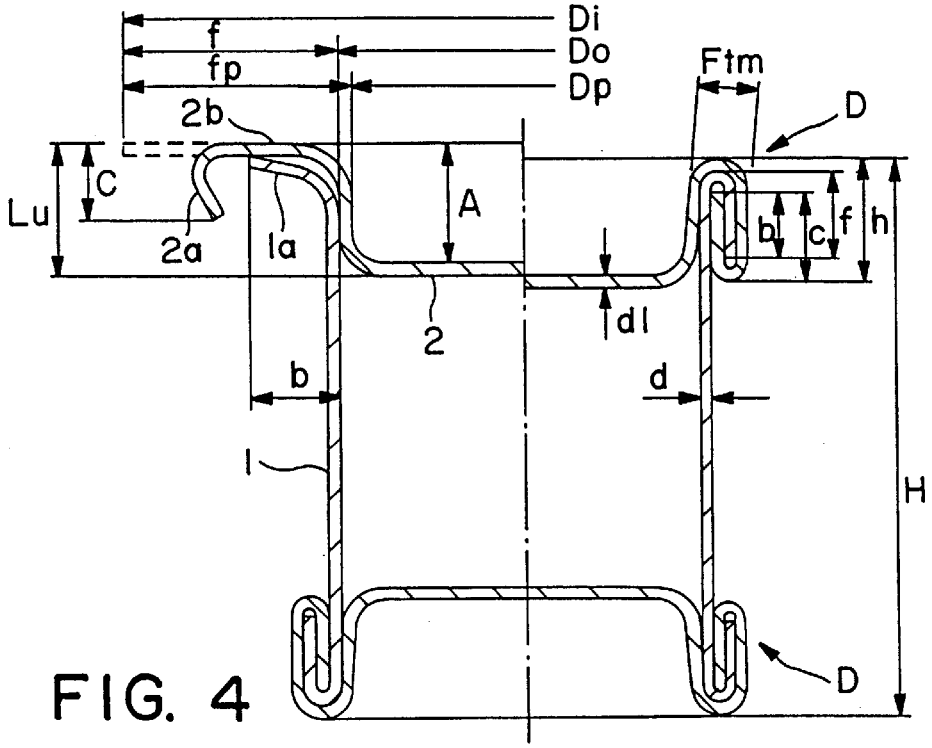
FIG. 4.
Figure 5:
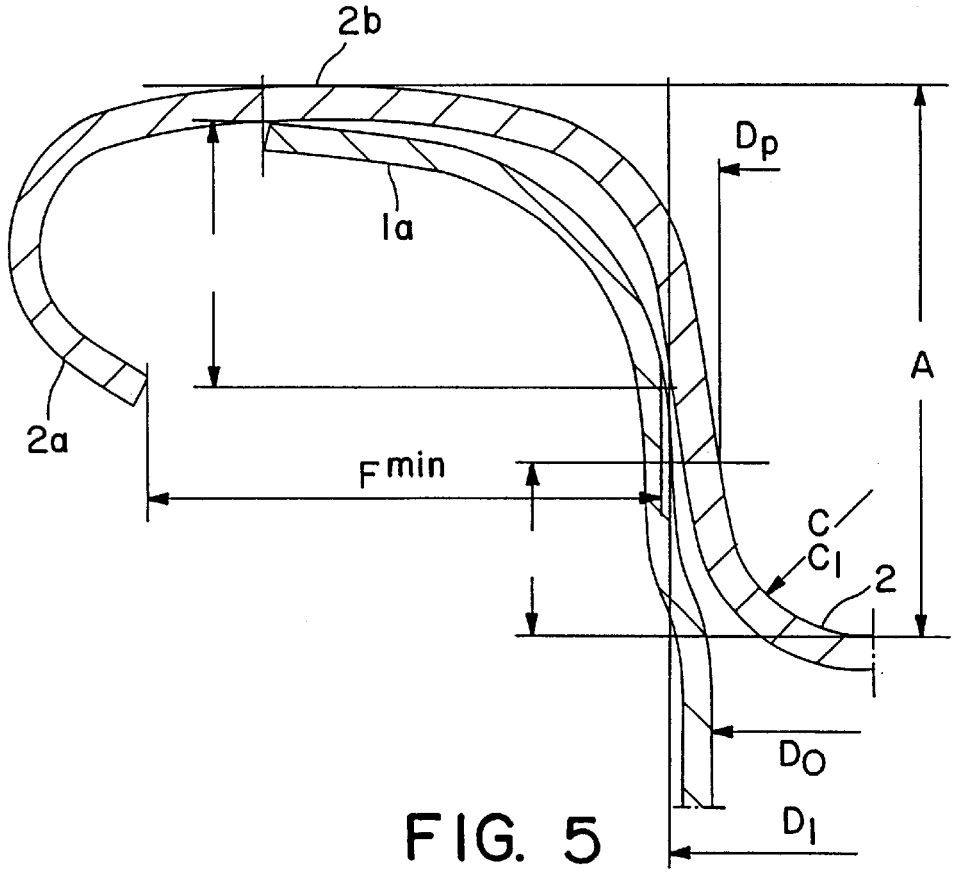
FIG. 5 show embodiments of usual seam geometries on metal cans.

FIG. 2 is an exaggerated illustration showing a (frustoconical) inclination of said body hook 1*a*, said inclination being substantially horizontal with an only slight inclination, such as shown in FIGS. 4 and 5.

In FIG. 2, the downward movement is designated by a velocity v which is changed depending on the position of said can body 1 and the interspace between said can body 1 and said compound 10. The smaller the interspace between said body 1 and said fluid 10, the lower the velocity of said downward movement.

During said downward movement or immediately when contacting or being dipped into said fluidal compound 10, said body 1 may rotate around the can axis 100, thus improving the uniformity of application of said compound.

A movement y of said fluid 10 is schematically illustrated, representing a slight movement of said fluid or at least a continuous replacement of fluid in a quantity corresponding to the quantity of sealant being applied to said body hooks 1*a* which are dipped into or brought in contact with said sealant. Said fluidal compound 10 may be produced by an extruder, its temperature may be controlled to maintain its viscosity on a substantially constant level.

FIG. 3 illustrates a sealant loa being positioned on said body hook 1*a* in an exactly dosed quantity. Said Figure only shows an edge portion 1*a* of said can body 1 being illustrated in upright position with its base downwards. If, after dipping and removing said body, said compound 10 still presents a certain mobility or viscosity, said compound 10*a* is still able to slightly move in radially inward direction on the can end seam 1*a* after quickly reversing said can 1.

Said movement in radially inward and downward direction depends on the ambient temperature and the inclination of said body hook 1*a* with regard to the horizontal plane.

Figure 1:
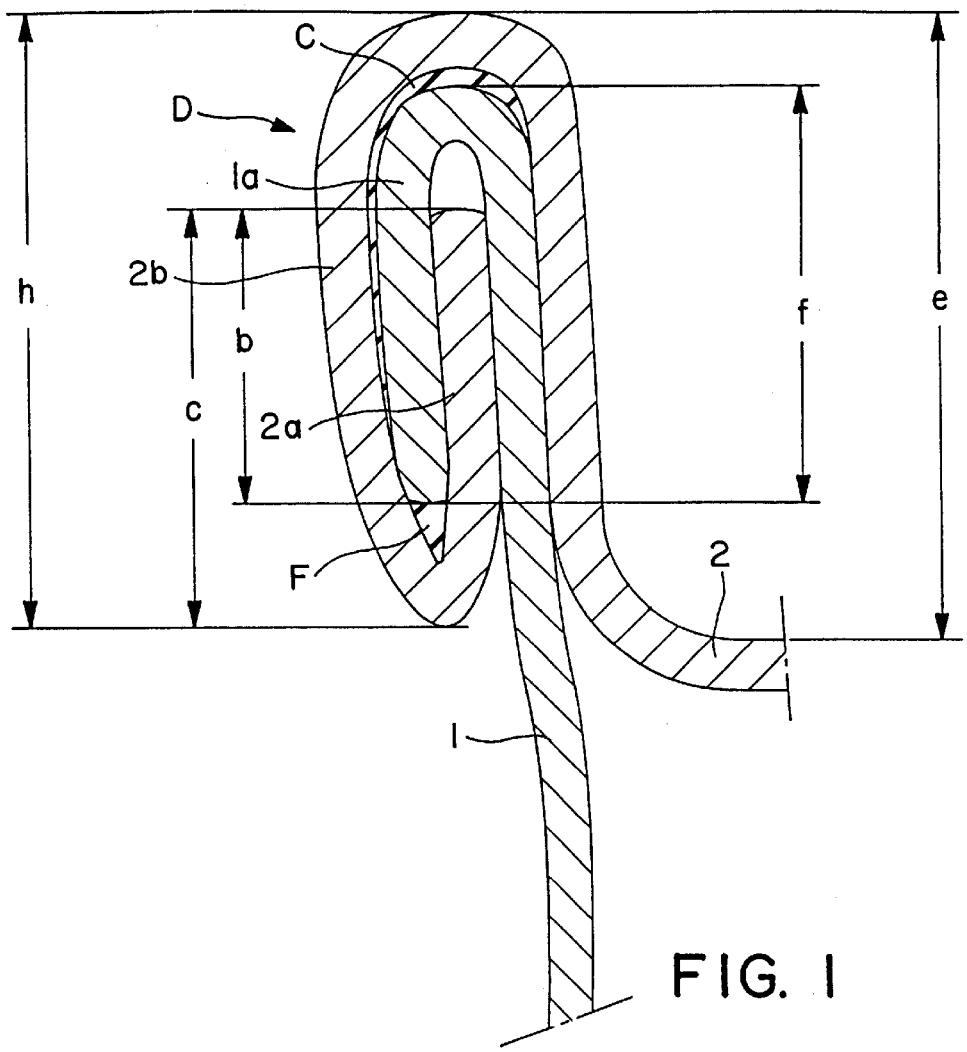
FIG. 1 illustrates a closed double seam being provided on the upper edge of a metal packing. D designates the double seam, reference numeral 1 designates the body of the metal can and reference numeral 2 designates the can end.

If the body hook 1*a* is dipped somewhat more deeply into said fluid 10, a bilateral coating 10*b* with compound is provided around the outer edge 1*b* of said body hook 1*a*, thus forming a lower sealing portion F when seaming. Said compound portions C and F according to FIG. 1 are indicated in FIG. 3.

FIG. 4 and FIG. 5 comprise usual seam dimension and their usual reference numerals.

What is claimed is:

1. A process for the application of seal between an end hook and a body hook of a double seam between a metal lid end and a metal can body of a metal packing, whereby a coating is applied to said body hook before attaching said metal lid end, said coating being applied to said body hook by bringing said body hook into contact with a fluidal coating and thereby positioning the fluidal coating on at least an inner portion of said body hook, said hook having said inner portion between a wall of said can body and an outer edge portion and said inner portion forming the main part of said body hook forming an angle of above 90° and lower than 180° with respect to the can body wall, providing a frustoconically inclined body hook;

during said application of said coating said can body being rotated and after said application said fluidal coating being allowed to dry at said body hook;

and therewith provide a thicker coating on the body hook than inside the can body on the wall of said can body.

2. The process according to claim 1, wherein at least one of a radial position and a distribution of the applied coating is modified by quickly reversing said metal can body after contacting said coating and wherein said modification is directed radially inward along the frustoconical inclined body hook.

3. The process of claim 1, wherein at least one of a radial position and a distribution of the applied coating is modified by quickly reversing said metal can body after contacting from above into said fluidal coating, and wherein said modification is directed radially inward along the frustoconical inclined body hook.

* * * * *